US005458210A

United States Patent [19]

Sollami

[11] Patent Number: 5,458,210

[45] Date of Patent: Oct. 17, 1995

[54] DRILL BITS AND BLADES THEREFOR

[75] Inventor: Phillip Sollami, Herrin, Ill.

[73] Assignee: The Sollami Company, Herrin, Ill.

[21] Appl. No.: 136,807

[22] Filed: Oct. 15, 1993

[51] Int. Cl.[6] ..... E21B 10/58

[52] U.S. Cl. ..... 175/420.1

[58] Field of Search ..... 175/420.1, 415, 175/427; 299/79

[56] References Cited

U.S. PATENT DOCUMENTS

| | | | |
|---|---|---|---|
| 2,597,771 | 5/1952 | Bergstrom | 175/420.1 |
| 3,447,616 | 6/1969 | Granat | 175/420.1 X |
| 5,287,937 | 2/1994 | Sollami et al. | 175/420.1 X |

FOREIGN PATENT DOCUMENTS

| | | | |
|---|---|---|---|
| 0148098 | 9/1952 | Australia | 175/420.1 |

*Primary Examiner*—Terry Lee Melius
*Attorney, Agent, or Firm*—Patnaude, Videbeck & Marsh

[57] ABSTRACT

A drill blade for a drill bit intended to be used to bore holes in the roofs of mines is made of hardened tungsten carbide. The blade has two end sections, one on each side of a central section, and the end sections have a higher degree of hardness than the hardness of the central section. Also, the central portion of the blade is made thicker than the distance between the planar surfaces of the end portions thereof such that the blade has a central protrusion and will be self centered on a slot in the bit body having a recess adapted to receive the central protrusion.

14 Claims, 6 Drawing Sheets

DRILL BITS AND BLADES THEREFOR

The present invention generally relates to drill bits and more particularly to drill bits having blades made of tungsten carbide having two different hardnesses and further to blades having enlarged mid-sections adapted to fit in a drill body having a grooved slot for retaining and centering the blade therein.

BACKGROUND OF THE INVENTION

Drill bits adapted to bore through rock for the installation of roof mounts in mines and the like have a carbide blade mounted in a transverse slot at the distal end of a drill body such as an elongate hollow tubular body. The drill body has access ports positioned near the blade, and the ports communicate with the inner bore of the body. Such blades are adapted to drill holes having a diameter of one inch and larger into the stone roof of a mine. A vacuum is drawn through the hollow drill body to draw stone cuttings removed by the blade through the ports, through the hollow shaft of the drill bit, and to a collection location remote from the drilling. Alternately, a water flushing system may be used in which pressurized water is forced through the drill body, and out ,through the ports to flush the cuttings out the mouth of the hole.

To withstand the wear incurred as such drill bits bore through stone, the blades of such drill bits are typically made of tungsten carbide and have a hardness in the range of 89.0 to 91.0 on the Ra hardness scale. A relatively small increase in the hardness of the tungsten carbide of the blade will substantially extend the useful life of a drill bit, i.e., enable the drill bit to bore through substantially more stone before it becomes unusably dull. For example, a first drill blade which is harder than a second blade by a hardness rating of 0.5 on the Ra hardness scale may be capable of drilling through 50 percent or more stone than the second drill blade before becoming unusably dull.

On the other hand, harder carbide blades are more brittle than softer tungsten carbide blades and tend to fracture as a result of the stresses upon the blade, and as a result, the blades of drills used in mines usually have hardnesses closer to 90.0 than to 91.0. It has been found that tungsten carbide blades typically fracture along the central longitudinal axis of the blade as a result of the thrust forces applied during the drilling.

A drill blade attached to a drill bit and used to bore a cylindrical hole is subjected to a number of forces. At the center of the drill blade, the thrust forces arising from the drill being forced into the hole are maximized. At the outer edges of the blade, on the other hand, strong shear forces are developed as the blade removes stone to extend the hole. The cutting edges of drill blades generally wear most noticeably at the outer ends rather than at their centers because the blade speed and the sheer forces are greater at the ends of the blade than at the center.

It would be desirable to have a blade which is very hard at the outer edges thereof so as to resist the wear as the blade bores into stone, and to have a softer, less brittle portion in the center thereof where it is subjected to the maximum thrust forces.

Other factors also affect the useful life of a drill bit. If, for example, the blade is not centered on the body of the drill bit, it will be subjected to uneven forces causing stress and breakage of the blade. It would also be desirable to provide an improved drill bit and drill blade therefor which would be more easily centered upon the body of a drill bit and which would thus reduce the incidence of fracture along the centerline thereof.

BRIEF DESCRIPTION OF THE INVENTION

Briefly, the present invention is embodied in a novel drill blade which has harder and softer portions, the harder portions being positioned at the outer edges thereof for improving the cutting qualities of the blade, and the softer portions being positioned near the central portion of the blade for bearing the thrust forces through the length of the drill.

Specifically, the blade has a body member having a cutting edge portion at the front end and a mounting portion at the rear end. The cutting edge portion has two end sections, one end section on each side of a central section, and the end sections are made of tungsten carbide having a relatively high degree of hardness. The central section, which is positioned between the two end sections, is made of tungsten carbide with a lower degree of hardness. As a result, the cutting edge portion of the body which is made of a harder tungsten carbide will be suitable for boring through stone, whereas the central portion of the blade which is made of a softer carbide will be suitable for bearing the thrust forces, and will be less likely to fracture as a result thereof than are the prior art blades.

To further resist fracturing along the center of such blades, the central section of one embodiment of the blade has a greater width than the width between the planar sides of the blade body at the ends. A drill bit with a blade having a larger width at the center than the width at the ends of the blade is retained within a complementary shaped groove on the bit body, and as a result it will be self-centering prior to brazing and will be less subject to fracture.

GENERAL DESCRIPTION OF THE DRAWINGS

Further objects and advantages and a better understanding of the present invention will be had by reference to the following detailed description taken in conjunction with the accompanying drawings wherein.

DETAILED DESCRIPTION OF PREFERRED EMBODIMENTS OF THE INVENTION

Figure 3:
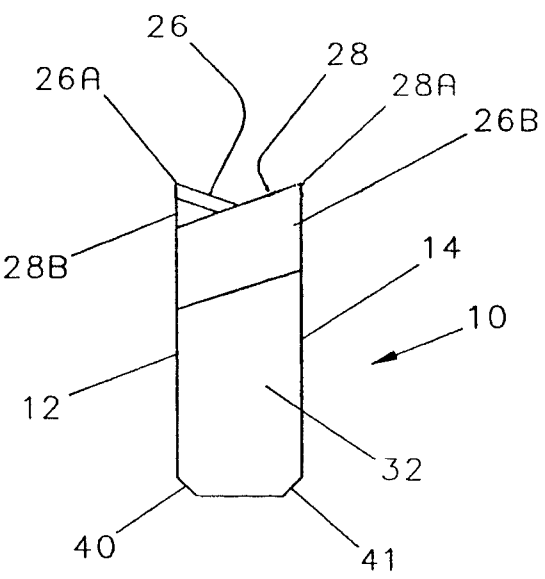
FIG. 3 is an end view of the blade body shown in FIG. 1.
Figure 2:
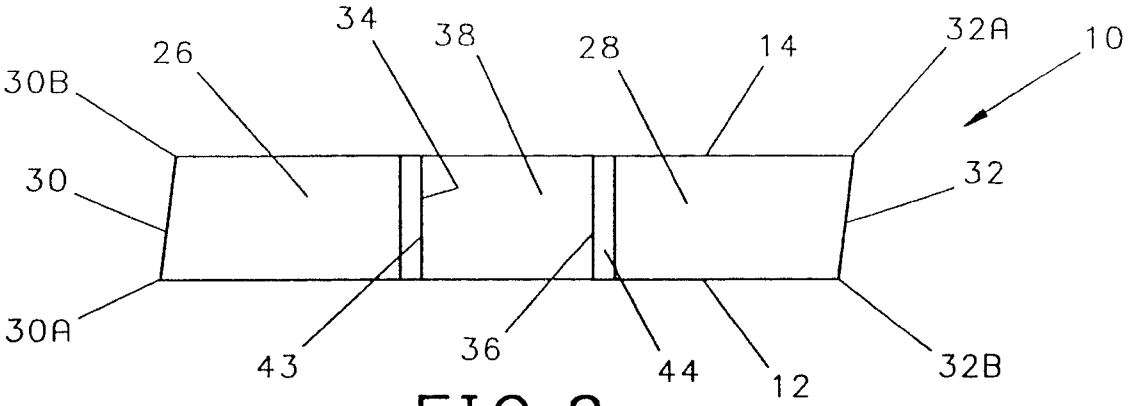
FIG. 2 is a top view of the blade body shown in FIG. 1.
Figure 1:
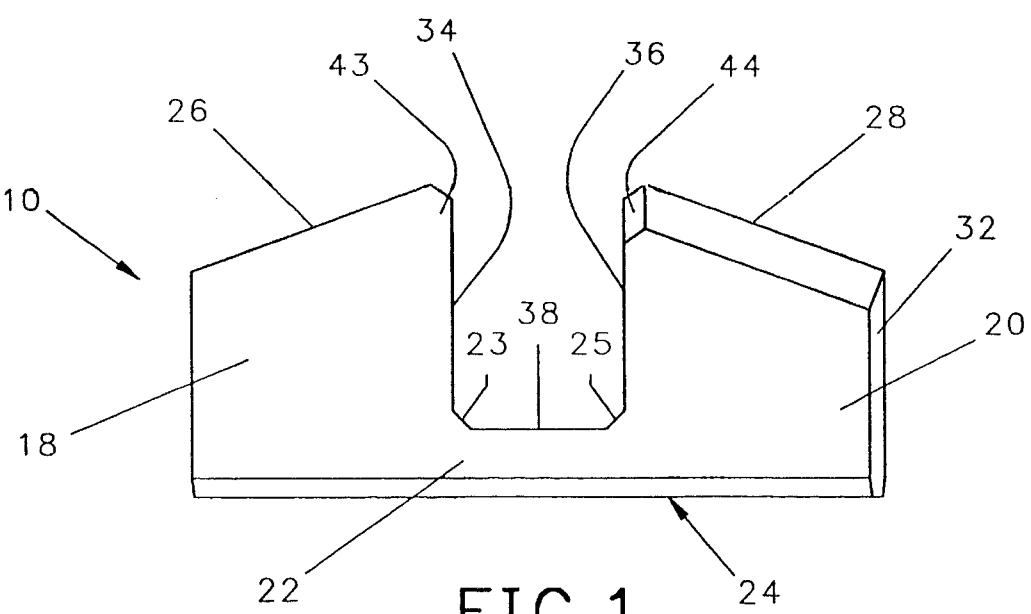
FIG. 1 is a front elevational view of a blade body in accordance with the present invention.

Referring to FIGS. 1, 2 and 3, a drill blade constructed in accordance with the present invention has a blade body 10 having two substantially planar parallel sides 12, 14. The blade body 10 has two spaced apart outer end sections 18, 20 separated by a center section 22 positioned along the lower end 24 of the blade body 10. The upper or front end of each of the end sections 18, 20 has a cutting end 26, 28, respectively. At the corners between the center section 22 and the outer end section 18, 20 are angular corner breaks 23, 25 which increase strength and stability by distributing loads at these locations.

As can best be seen in FIG. 3, the cutting ends 26, 28 are not perpendicular to the sides 12, 14 of the blade body 10 but are angled relative thereto. Each of the cutting ends 26, 28 has a leading elevated cutting edge **26*a*, 28*a*, respectively, and a trailing lower relief edge 26*b*, 28*b*, respectively. Similarly, the outer end surfaces 30, 32 of the blade body 10 are substantially parallel to one another but are also not perpendicular to the sides 12, 14. The end surfaces 30, 32 also have leading edges 30*a*, 32*a* which extend outwardly relative to the trailing edges 30*b*, 32*b* to form relief angles such that the end surfaces 30, 32 do not bind against the sides of a hole cut by the blade 10. Each of the end portions 18, 20 has a planar inner surface 34, 36, respectively, and the inner surfaces 34, 36 are parallel to each other and are substantially perpendicular to the sides 12, 14 and to the lower end 24. Extending between the bottom ends of the inner surfaces 34, 36 is an upper surface 38 of the center portion 22. As can best be seen in FIG. 3, the lower end 24 has chamfers 40, 41 one of which is positioned on each side of the blade. Similarly, each of the end sections 18, 20 has a chamfer 43, 44 at the intersection of the respective cutting edge 26, 28 and the adjacent inner surface 34, 36 thereof. The chamfers 43 and 44** provide additional cutting edges which increase drilling penetration. It should be recognized that these chamfers and the additional cutting edges formed thereby can be omitted without detracting from other features of the invention.

Figure 6:
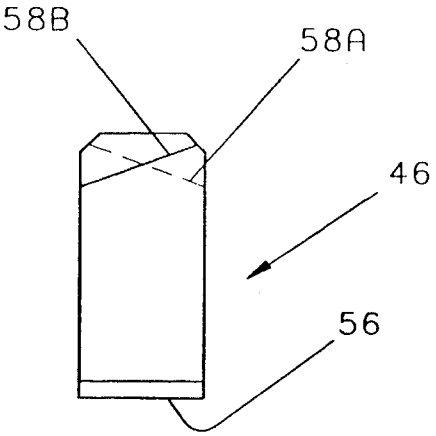
FIG. 6 is an end view of the central insert shown in FIG. 4.
Figure 5:
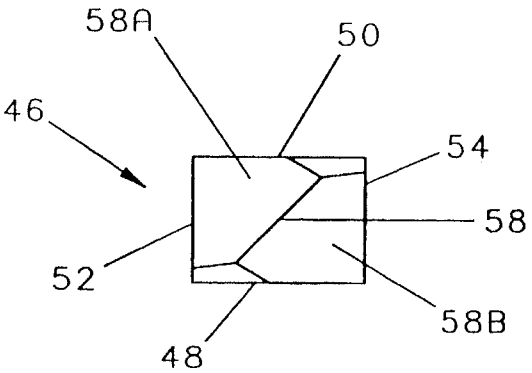
FIG. 5 is a top view of the central insert shown in FIG. 4.
Figure 4:
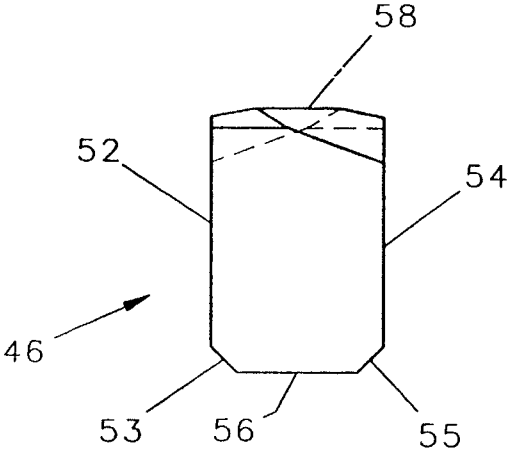
FIG. 4 is a side elevational view of a central insert for use with the blade shown in FIG. 1.

Referring to FIGS. 4, 5 and 6, a central insert 46 in accordance with the present invention is also made of tungsten carbide but of a softer grade than that used to form the body 10. The central insert 46 has parallel sides 48, 50 which are spaced apart a distance which is substantially equal to the distance between the parallel sides 12, 14 of the blade body 10. It also has substantially parallel ends 52, 54 which are perpendicular to the parallel sides 48, 50, and spaced apart from each other a distance which enable the central insert to fit snugly between the inner surfaces 34, 36 of the blade body 10. The central insert 46 further has a planar bottom 56 with chamfers 53, 55 at the intersections of the bottom 56 and the two sides 52, 54 thereof.

Figure 7:
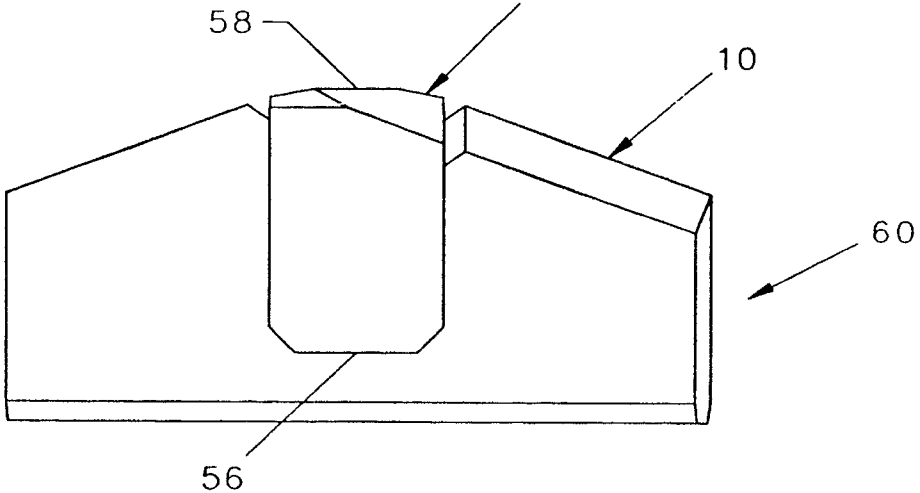
FIG. 7 is a side elevational view of a blade in accordance with the present invention having the blade body shown in FIG. 1 and the central insert shown in FIG. 4 assembled thereto.

As shown in FIG. 7, the insert 46 has a cutting edge 58 is formed by two angular portions **58*a*, 58*b* which are positioned and sloped such that when the insert 46 is positioned between the inner surfaces 34, 36 of the blade body 10 and the bottom 56 is positioned against the upper surface 38 of the central section 22, angular portion 58*a* will be coplanar with cutting surface 26 and angular portion 58*b* will be coplanar with cutting surface 28 of the blade body 10. The planar surfaces of angular portions 58*a*, 58*b* intersect with each other and form a central edge 58. When the central insert 46 is positioned and brazed between the inner surfaces 34, 36 of the end sections 18, 20 with the bottom 56 thereof against the upper surface 38 and brazed therein, the blade body 10 and central insert 46 combined to make a single blade 60 in accordance with the present invention. The central insert 46 can be joined to the body 10** by brazing or any process known in the art.

Figure 9:
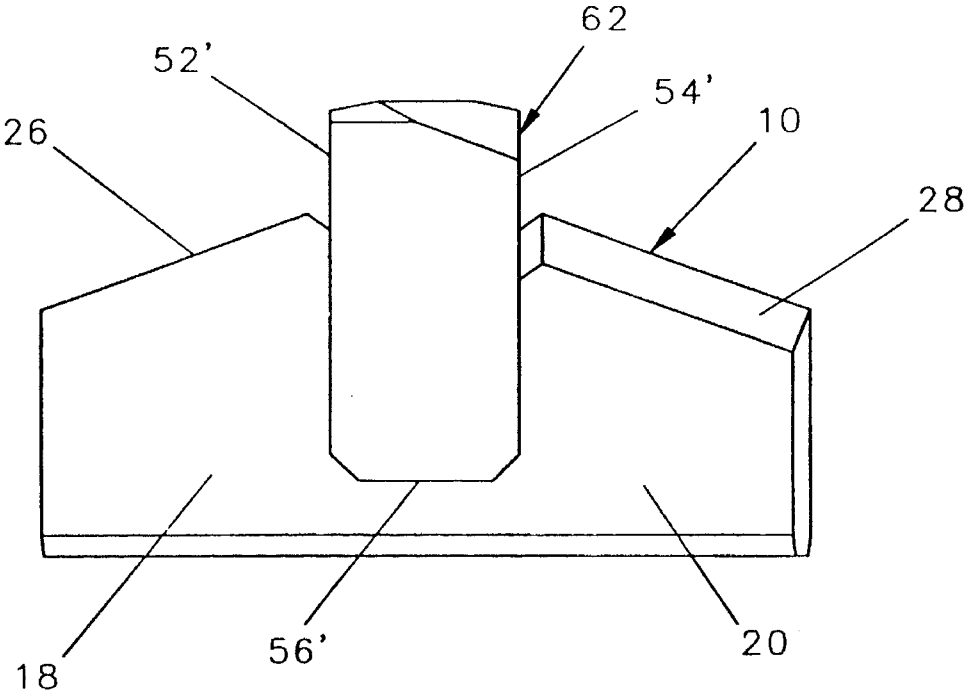
FIG. 9 is a side elevational view of the blade body of FIG. 1 with the central insert of FIG. 8 fitted therein.
Figure 8:
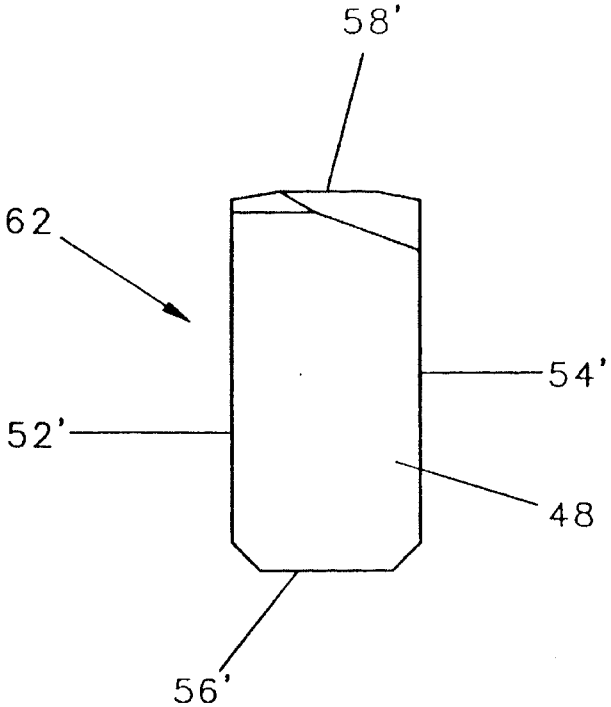
FIG. 8 is a side elevational view of a first alternative embodiment of the invention.
Figure 12:
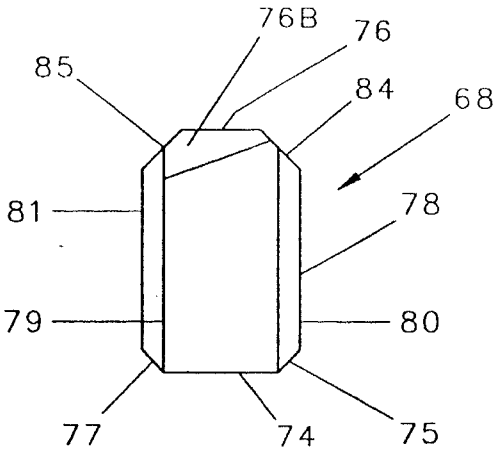
FIG. 12 is an end view of the central insert shown in FIG. 10.

Referring to FIGS. 8 and 9, an alternate embodiment of a central insert 62 is shown which has a configuration similar to the configuration of the insert 46 previously discussed, and for which like portions bear indicia numbers like those of the first embodiment except that they are primed. In this embodiment the height of the ends 52' 54', that is the distance between the bottom 56' thereof and the sides of cutting portions **58*a*, 58*b* thereof, is substantially greater than the height of the inner surfaces 34, 36, i.e., the distance between the upper surface 38 and the inner ends of the cutting ends 26, 28, respectively. As a result, when the central insert 62 is fitted between the end sections 18, 20 with the bottom 56' of the insert 62 against the upper surface 38 of the center section 22, the cutting upper edge 58' will be positioned a substantial distance above the cutting edges 26, 28 of the blade body 10. The edges formed by the intersection of the ends 52', 54' and the sides 48', 50' which extend above the cutting edges 26, 28** form additional cutting edges which give the blade enhanced penetration capabilities.

Figure 13:
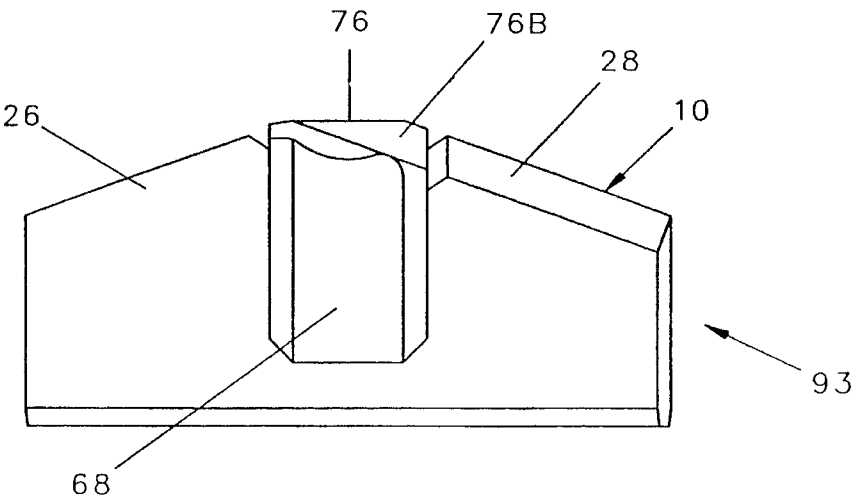
FIG. 13 is a side elevational view of the blade body shown in FIG. 1 fitted with the insert shown in FIG. 10.

Referring to FIGS. 10, 11, 12 and 13, another embodiment of a central insert 68 is shown. The central insert 68 has parallel planar ends 70, 72 which are spaced apart from each other a distance such that the planar ends 70, 72 fit snugly between the inner surfaces 34, 36 of the blade body 10 as was the case with the prior embodiments of a central insert described above. The central insert 68 also has a planar bottom 74 with chamfers 71, 73 and a cutting upper edge 76. The cutting upper edge 76 is formed by intersecting angular planar surfaces **76*a*, 76*b* angled and positioned with surface 76*a* coplanar with the surface of cutting edge 26 and surface 76*b* coplanar with the surface of cutting edge 28 of the blade body 10 as shown in FIG. 13**.

Figure 11:
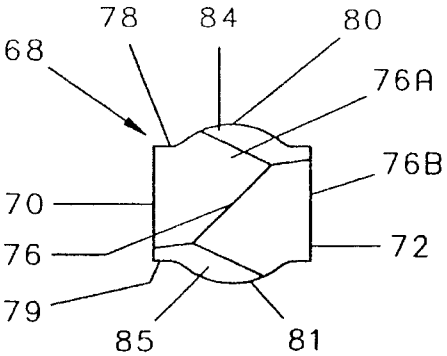
FIG. 11 is a top view of the central insert shown in FIG. 10.
Figure 10:
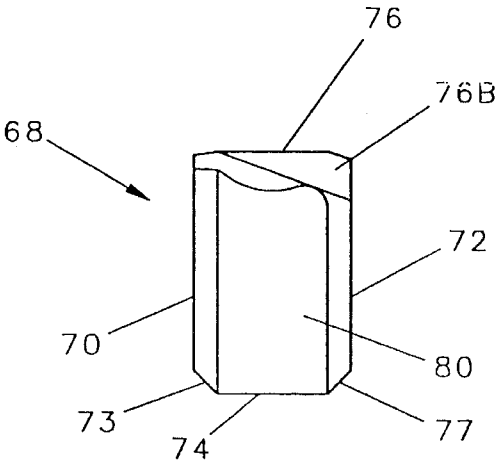
FIG. 10 is a side elevational view of a second alternative embodiment of the invention.
Figure 20:
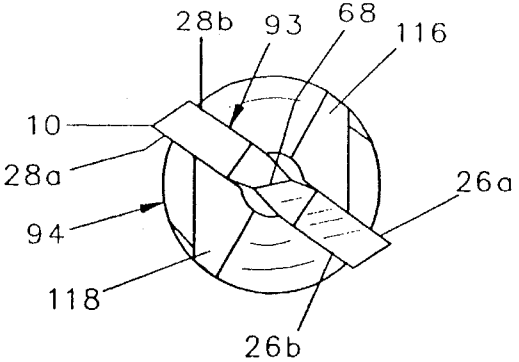
FIG. 20 is a top view of the blade shown in FIG. 13 fitted into the drill body shown in FIG. 17.
Figure 19:
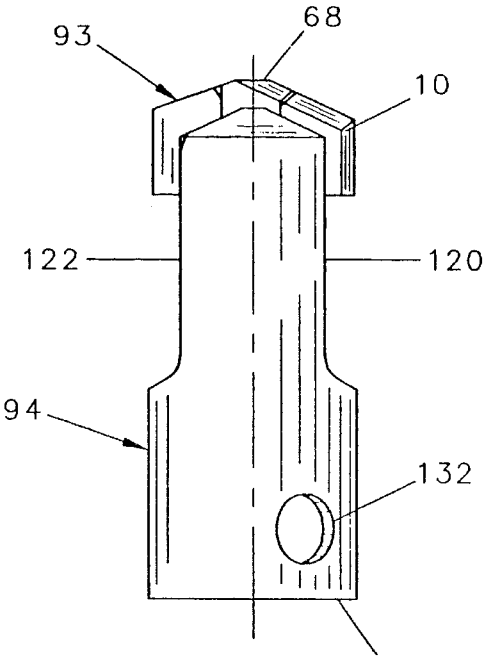
FIG. 19 is a front view of the blade shown in FIG. 13 fitted into the body shown in FIG. 17, with the drill body rotated 90 degrees from the position shown in FIG. 17.
Figure 18:
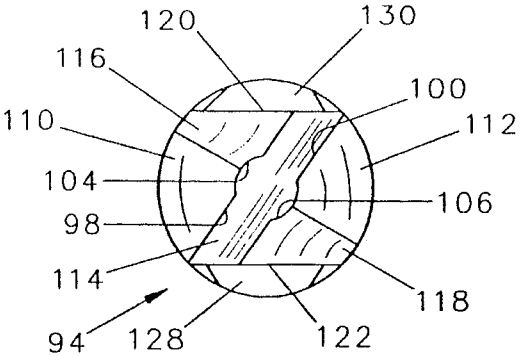
FIG. 18 is a top view of the drill body shown in FIG. 17.
Figure 17:
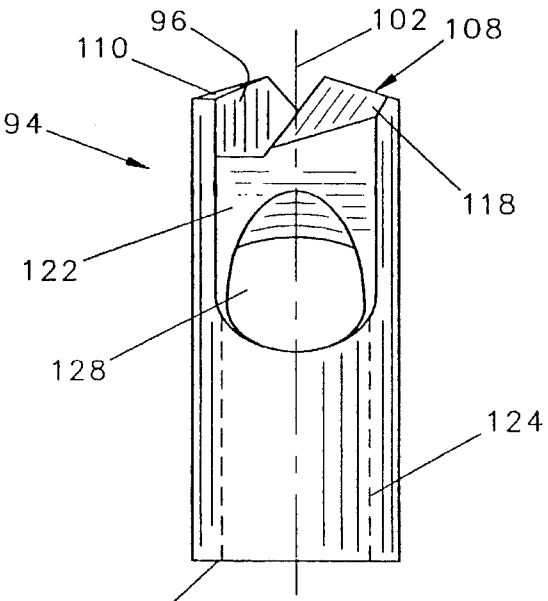
FIG. 17 is a side elevational view of a drill body suitable for receiving the drill blade shown in FIG. 13.

The insert 68 further has opposing sides 78, 79. As can be seen in FIG. 11, each of the sides 78, 79 has an arcuate shaped protrusion 80, 81, respectively, such that the width of the insert 68, that is, the maximum distance between the protrusions 80, 81 is greater than the distance between the sides 12, 14 of the blade body 10. As shown in FIG. 20, in an assembled blade having an insert 68 positioned between the end sections 18, 20 of a blade body 10 the arcuate shape of the protrusions 80, 81 will extend outward from the side surfaces 12, 14 of the blade body 10. The central insert 68 further has chamfered upper sides 84, 85 such that the protrusion of the outer surfaces 80, 81 is tapered inwardly near the cutting upper edge 76, and has second chamfers 75, 77 at the lower ends thereof.

Figure 14:
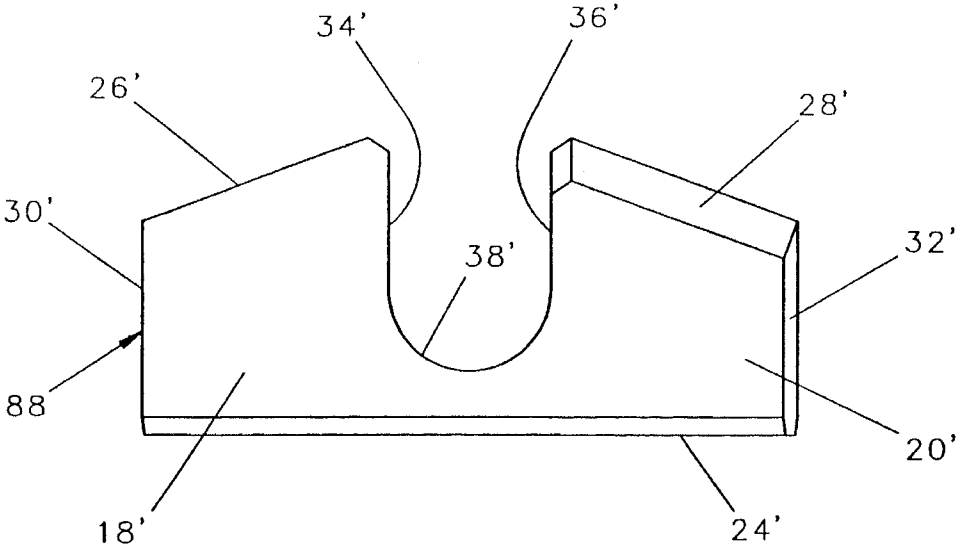
FIG. 14 is an alternative embodiment of the invention.
Figure 16:
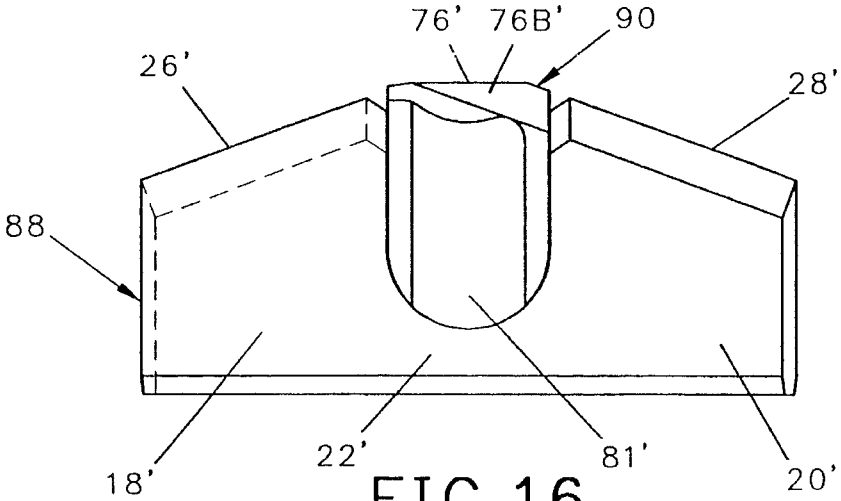
FIG. 16 is a side elevational view of the blade body shown in FIG. 14 fitted with the central insert shown in FIG. 15.

Referring to FIG. 14 and 16, an alternate embodiment of a blade body 88 is shown. In this embodiment of the blade body 88, the portions thereof which are similar to portion of the blade body 10 previously described bear similar indicia numbers except they are primed. The blade body 88 differs from the blade body 10 in that the upper surface 38' of the central portion 22' of the blade body 88 is arcuate and not planar. The arcuate upper surface 38' provides greater strength to the body 88 than is available to the body 10 previously described because the weak corners are eliminated.

Figure 15:
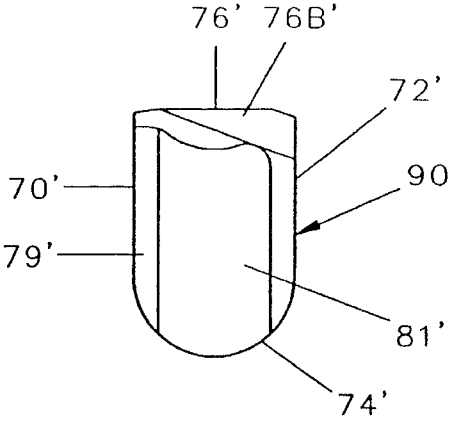
FIG. 15 is a side elevational view of a central insert suitable for insertion in the blade body shown in FIG. 13.

Referring to FIG. 15 and 16, an insert 90 suitable for use with the blade body 88 is shown which is substantially similar to the central insert 68 previously described, and parts of the central insert 90 which are like parts of the central insert 68 bear like indicia numbers except they are primed. As can be seen, the bottom 74' of the central insert 90 is not planar, but arcuate and complementary in shape to the upper surface 38' of the blade body 88. As a result, when the central insert 90 is fitted between the inner surfaces 34', 36' of the blade body 88 as shown in FIG. 16, the surfaces of the angular surfaces of which only **76*b* is shown, will be coplanar with the surfaces of the cutting ends 26', 28' of the blade body 88. The arcuate upper surface 38' will reduce the likelihood of fracture in the central portion 22' of the blade body 88**.

An assembled blade 93 as shown in FIG. 13 having a blade body 10 and an attached central insert 68 with protrusions 80, 81 which extends beyond the outer sides 12, 14 thereof, can be fitted within a drill bit body 94 as shown in FIGS. 17–20. At one end of the drill bit body 94 is a transverse slot 96 having parallel side surfaces 98, 100, which are spaced apart a distance which is a little greater than the distance between the parallel sides 12, 14 of the blade body 10 and are parallel to the longitudinal axis 102 of the drill bit body 94. Two longitudinal recesses 104, 106, one in each of the side surfaces 98, 100, respectively, have arcuate surfaces which are shaped complementary to the shape of the protrusions 80, 81, of the central insert 68. As a result of the foregoing, the assembled blade 93 will slideably fit within the transverse slot 96 of the drill bit body 94 with the protrusion 80, 81 received within the longitudinal recesses 104, 106, respectively.

An assembled drill blade 93 having longitudinal side protrusions 80, 81 will be self-centered within the transverse slot 96, and can be brazed while the blade is retained in position therein. Also, a drill bit, having a blade with an enlarged central section, will be less subject to fracturing along the axis thereof as a result of thrust forces than are the prior drill bits.

The upper end 108 of the body 94 which is adapted to retain the blade 10 is not planar, but has frustoconical surfaces 110, 112 which are adapted to fit behind the trailing edges **26*b*, 28*b* of the blade 93 and transfer force to the blade as torque is applied to the body 94 during drilling. The distance from the bottom of the slot 96 to the frustoconical surfaces 110, 112 is a little less than the distance from the lower end 24 to the trailing edges 26*b* and 28*b* of the blade 93 such that when the blade is fitted in the slot 96, the cutting edges 26*a*, 28*a* extend well above the frustoconical surfaces 110, 112. The end surface 108 of the body 94 also has ramp segments 116, 118, which slope toward the bottom of the slot 96 such that when the blade 93 bores a hole in rock or other substances, a cavity is formed between the walls of the bore and the ramp segments 116, 118. Also, a pair of flats 120, 122 are positioned one on each of the opposing sides of the body 94 and the surface thereof intersect with the ramp segments 116, 118, respectively, such that the cavity formed above the ramp segments 116, 118 extend along the flats 120, 122 and down the sides of the body 94**.

In the preferred embodiment, the body 94 is provided with an axial hole 124 in the lower end 126 thereof which has a hexagon shaped cross-section adapted to be fitted on a hollow drill shaft with a hexagon end, not shown. A pair of transverse ports, 128, 130, extend from the flats 120, 122, to the bore 124, such that cuttings removed by the blade 93 will drop on the ramp segments 116, 118 and fall along the flats 120, 122 and may be drawn by a vacuum through the ports 128, 130 and through the bore 124, down a hollow drill shaft, not shown, to a remote location for accumulation and removal.

A transverse hole 132 adjacent the end 126 of the body 94 extending into the bore 124 therein is adapted to receive a retainer clip (not shown) which is mounted to the drill steel, or attached by any other appropriate means to secure the body 94 to a drill shaft, not shown.

There is provided, therefore, in accordance with the present invention, an improved blade 93, the central section of which is made of a relatively soft grade of tungsten carbide so as to better withstand the thrust forces of drilling. The outer end section of the blade which include the cutting edges, on the other hand, are made of a relatively hard grade of tungsten carbide so as to better withstand wear during drilling. To maximize the effectiveness of the drill blades, the outer end sections of the blades should have a hardness in the range of of 90.0 to 91.5 on the Ra hardness scale while the central portions should have a hardness in the range of 88.0 to 89.5.

In some of the embodiments disclosed, the central portion is thicker so as to further improve the strength of the blade and its ability to withstand thrust forces. Also, the longitudinal protrusions slide within complementary shaped recesses in the sides of the slot at one end of the drill body to provide improved centering of the blade on the drill body during the brazing operation.

While the present invention has been described in connection with particular embodiments, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. A drill blade for attachment to a drill bit used to bore a cylindrical hole, said drill blade comprising in combination:

a body having a cutting edge portion at one end thereof and a mounting portion at the opposite end thereof, said cutting edge portion having a central section for boring a central portion of a hole and two outer end sections for boring outer portions of a hole, and said central section being made of a softer material than the material of which said outer end sections are made.

2. A drill blade in accordance with claim 1 wherein said body is made of tungsten carbide, and said tungsten carbide of said central section is softer than said tungsten carbide of said outer ends.

3. A drill blade in accordance with claim 1 and further comprising a protrusion disposed of one side of said mounting portion of said blade.

4. A drill blade in accordance with claim 3 wherein said body is made of tungsten carbide, and said tungsten carbide of said central section is softer than said tungsten carbide of said outer ends.

5. A drill blade for attachment to a drill bit used to bore a cylindrical hole, said drill blade comprising in combination:

a blade body having a cutting edge portion at one end thereof and a mounting portion at the opposite end thereof, said cutting edge portion having two outer end sections for boring outer portions of a hole, one outer end section on each side of a central section, and a central insert fitted between said outer end sections, said central insert for boring a central portion of a hole and being made of a softer material than said outer end sections.

6. A drill blade in accordance with claim 5 wherein said body and said central insert are made of tungsten carbide, and said tungsten carbide of said central insert is softer than said tungsten carbide of said outer ends.

7. A drill blade in accordance with claim 5 wherein said body and said central insert each have a thickness, and said thickness of said central insert is greater than said thickness of said body.

8. A drill blade in accordance with claim 5 wherein said blade body has a central section between said two outer end sections, said central section of said blade body having an arcuate upper surface, and said central insert having a lower surface which is arcuately shaped complementary to said arcuate shape of said upper surface of said central section of said body.

9. A drill blade in accordance with claim 6 wherein said central insert has a height which is greater than a height of said outer end sections such that an upper end of said central insert extends substantially above said outer end sections.

10. In a drill blade having a cutting edge and a mounting portion, said cutting edge having a central portion for boring a central portion of a hole, said central portion being positioned between outer end portions, said outer end portions for boring outer portions of a hole, the improvement comprising:

said central portion being made of a first substance having a given hardness and said outer end portions being made of a second substance having a hardness greater than said given hardness of said outer end portions.

11. The improvement of claim 10 wherein both said first and said second substances are tungsten carbide.

12. A drill blade comprising in combination:

an elongate body member having a transverse slot at one end thereof, a blade member having a body with a cutting edge at one end thereof and a mounting portion at the opposite end thereof which is complementary in cross-section to said transverse slot, said mounting portion being disposed in said transverse slot in said body member, said blade member having a protrusion disposed on one side of said mounting portion, said protrusion being received in a recess in one side of said slot, and said cutting edge of said blade having a central section and two outer end sections, said central section having a hardness which is softer than a hardness of said two outer end sections.

13. A drill bit in accordance with claim 12 wherein said blade member is made of tungsten carbide.

14. A drill bit according to claim 13, wherein said blade member has a second protrusion disposed on the side of said mounting portion opposite said one side, said protrusions being centrally located on said blade member, said second elongate protrusion being received in a second recess in the other side of said slot.

* * * * *

UNITED STATES PATENT AND TRADEMARK OFFICE

CERTIFICATE OF CORRECTION

PATENT NO. : 5,458,210

DATED : October 17, 1995

INVENTOR(S) : Phillip Sollami

It is certified that error appears in the above-identified patent and that said Letters Patent is hereby corrected as shown below:

In column 3, line 5, after "Fig." delete "13" and substitute -- 14 --.

In column 8, line 9, after "said" second occurrence, delete "outer end portions" and substitute -- central portion --.

Signed and Sealed this

Twentieth Day of February, 1996

*Attest:*

*Attesting Officer*

Bruce Lehman

BRUCE LEHMAN

*Commissioner of Patents and Trademarks*